United States Patent [19]

Sakai et al.

[11] Patent Number: 5,014,521

[45] Date of Patent: May 14, 1991

[54] REFRIGERATION SYSTEM IN ICE MAKING MACHINE

[75] Inventors: Tadashi Sakai, Toyoake; Katsunobu Minari; Hideji Ohta, both of Nagoya, all of Japan

[73] Assignee: Hoshizaki Denki Kabushiki Kaisha, Aichi, Japan

[21] Appl. No.: 489,153

[22] Filed: Mar. 6, 1990

[30] Foreign Application Priority Data

Mar. 6, 1989 [JP] Japan ..... 1-53558

[51] Int. Cl.[5] ..... F25B 41/04

[52] U.S. Cl. ..... 62/212; 62/225; 236/92 B

[58] Field of Search ..... 62/212, 224, 225, 278, 62/81; 236/92 B

[56] References Cited

U.S. PATENT DOCUMENTS

| | | | |
|---|---|---|---|
| 2,669,849 | 2/1954 | Lange | 236/92 B X |
| 3,054,273 | 9/1962 | McGrath | 62/225 X |
| 3,252,279 | 5/1966 | Leimbach et al. | 62/225 |
| 3,570,263 | 3/1971 | Tobias | 62/225 X |
| 4,500,035 | 2/1985 | Kuroda et al. | 62/225 X |

*Primary Examiner*—William E. Tapolcai

*Attorney, Agent, or Firm*—Armstrong, Nikaido, Marmelstein, Kubovcik & Murray

[57] ABSTRACT

A refrigeration system in an ice making machine has an evaporator coil connected at its inlet side to an outlet of a refrigeration compressor through a condensing coil and at its outlet side to an inlet of the compressor. An expansion valve is interposed between the condensing coil and the evaporator coil. A bypass line is connected in parallel with the condensing coil and the expansion valve. A solenoid valve is disposed within the bypass line to permit the flow of hot gas supplied therethrough from the compressor into the evaporator coil when it has been energized. The expansion valve is in the form of an expansion valve of the externally equalized type associated with an external equalizer pipe having an extremity connected to an intermediate portion of the evaporator coil between the inlet and outlet sides thereof. A thermostat bulb is located on a return line between the outlet side of the evaporator coil and the compressor. The thermostat bulb is filled with an amount of inert gas, which is determined to cause a maximum working pressure acting on the expansion valve, which is higher than the pressure of refrigerant at the intermediate portion of the evaporator coil during the freezing cycle and which is lower than the pressure of hot gas at the intermediate portion of the evaporator coil during the defrost cycle.

2 Claims, 1 Drawing Sheet

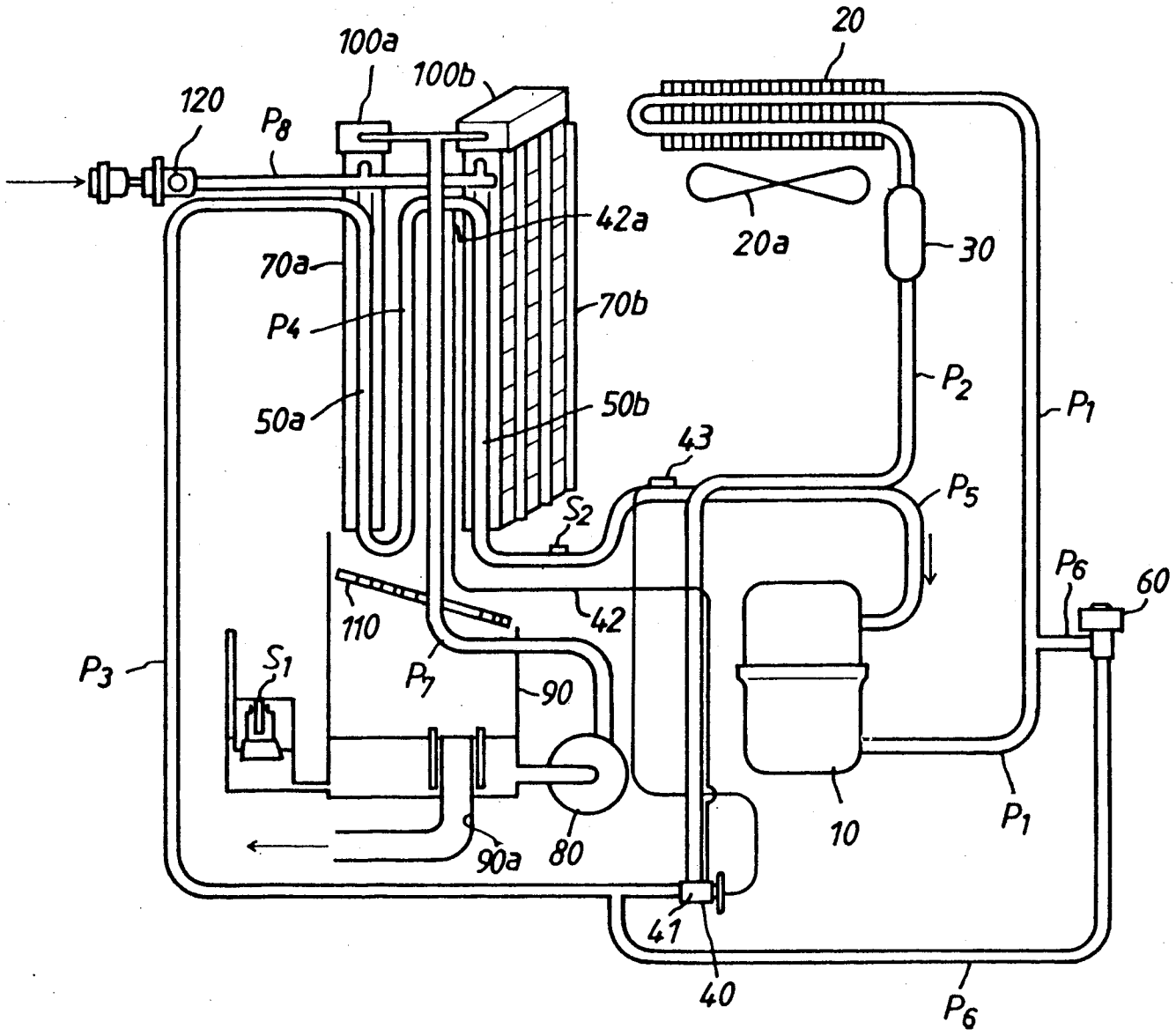
60
P6
P1
P1
P6
30
P2
P5
20
10
20a
40
41
43
42a
70b
50b
S2
42
80
90
90a
100b
P7
100a
110
70a
P4
50a
S1
P8
120
P3

REFRIGERATION SYSTEM IN ICE MAKING MACHINE

BACKGROUND OF THE INVENTION

1. Field of the Invention

The present invention relates to ice making machines, more particularly to an improvement of the refrigeration system in the ice making machines.

2. Discussion of the Prior Art

In conventional refrigeration systems, an externally equalized type of thermostatic expansion valve is disposed within the refrigerant inlet line of an evaporator coil taking into account the pressure drop at the evaporator coil. The expansion valve is associated with a thermostat bulb located on a refrigerant return line leading from the evaporator coil back to a refrigerant compressor and an external equalizer is connected to the return line at a position adjacent the thermostat bulb. Under control of the thermostat bulb and external equalizer, the expansion valve acts to control the amount of refrigerant supplied therefrom into the evaporator coil in accordance with the temperature detected by the thermostat bulb and the pressure detected by the external equalizer. During the defrost cycle of the ice making machine, the difference in pressure between the inlet and outlet sides of the evaporator coil increases due to the flow of hot gases directly supplied into the evaporator coil from the compressor through a solenoid valve for hot gas in a bypass line of the refrigeration system. As a result, the expansion valve may not be fully closed during the defrost cycle. For this reason, the temperature of refrigerant supplied into the evaporator coil does not rise to a desired value, resulting in deterioration of the defrost efficiency. If a maximum working pressure acting on the expansion valve was lowered to fully close the expansion valve during the defrost cycle, the freezing efficiency of the ice making machine would be deteriorated.

SUMMARY OF THE INVENTION

It is, therefore, a primary object of the present invention to provide an improved refrigeration system wherein the location of the external equalizer is determined in an optimal position to overcome the problems discussed above.

According to the present invention, there is provided a refrigeration system in an ice making machine, including an evaporator coil connected at an inlet side thereof to an outlet of a refrigerant compressor through a condensing coil and at an outlet side thereof to an inlet of the compressor. An expansion valve is interposed between the condensing coil and the evaporator coil to expand a liquified refrigerant applied thereto from the condensing coil and supply it into the evaporator coil. A hot gas bypass line is connected in parallel with the condensing coil and the expansion valve. A solenoid valve is disposed in the bypass line to permit the flow of hot gas supplied therethrough from the compressor into the evaporator coil. The expansion valve is in the form of an expansion valve of the externally equalized type associated with an external equalizer pipe having an extremity connected to an intermediate portion of the evaporator coil between the inlet and outlet sides thereof and a thermostat bulb located on a return line between the outlet side of the evaporator coil and the compressor. The thermostat bulb is filled with thermally expandable fluid, the amount of which is determined to cause a maximum working pressure acting on the expansion valve to be higher than the pressure of refrigerant at the intermediate portion of the evaporator coil during the freezing cycle of the system and to be lower than the pressure of hot gas at the intermediate portion of the evaporator coil during the defrost cycle of the system.

BRIEF DESCRIPTION OF THE DRAWINGS

Other objects, features and advantages of the present invention will be more readily appreciated from the following detailed description of a preferred embodiment thereof when taken together with the accompanying drawing, in which the single FIGURE illustrates an improved refrigeration system in an ice making machine in accordance with the present invention.

DESCRIPTION OF THE PREFERRED EMBODIMENT

A refrigeration system illustrated in the drawing includes a refrigerant compressor 10 arranged to compress a gaseous refrigerant and deliver it through the outlet line $P_1$ of the compressor to a finned condensing coil 20 provided with a motor driven cooling fan 20*a* in a usual manner. The condensing coil 20 cools and liquifies the gaseous refrigerant and passes it through a line $P_2$ to an externally equalized type of thermostatic expansion valve 40. A dryer 30 is disposed within an intermediate portion of line $P_2$ to remove water from the liquified refrigerant. The expansion valve 40 includes a valve body 41 associated with an external equalizer pipe 42 extending from the valve body 41 and a thermostat bulb 43 located on a refrigerant return line $P_5$ leading from an evaporator assembly 50*a*, 50*b* back to the compressor 10. The external equalizer pipe 42 has an extermity 42*a* connected to an intermediate line $P_4$ between evaporator coils 50*a* and 50*b* for communication with the refrigerant in line $P_4$. Thus, the valve body 41 is applied with the pressure of refrigerant in line $P_4$ through the external equalizer pipe 42. The connecting position of external equalizer pipe 42 to line $P_4$ has been selected on a basis of the fact that during the freezing and defrost cycles the difference in pressure between the inlet and outlet sides of evaporator coil 50*a* becomes larger than the difference in pressure between the inlet and outlet sides of evaporator coil 50*b*.

The thermostat bulb 43 is filled with inert gases such as a mixture of refrigerant and nitrogen the amount of which is determined to cause a maximum working pressure acting on the valve body 41 to be higher than the pressure of refrigerant in line $P_4$ during the freezing cycle and to be lower than the pressure of hot gas in line $P_4$ during the defrost cycle. The maximum working pressure acting on valve body 41 is also determined to be higher than the pressure of hot gas at the outlet side of evaporator coil 50 *b* during the defrost cycle. In operation, the thermostat bulb 43 acts to detect the temperature of refrigerant flowing through the return line $P_5$ and to apply the thermal expansion pressure of sealed inert gases to the valve body 41. Thus, the expansion valve 40 is controlled to be fully closed by the thermal expansion pressure applied thereto from thermostat bulb 43 during the defrost cycle. In this embodiment, the valve body 41 is provided therein with a diaphragm which is applied at one face thereof with the thermal expansion pressure from thermostat bulb 43 and at the other face thereof with a predetermined spring pressure and the pressure of refrigerant from the external equalizer pipe 42. During the freezing cycle, the expansion valve 40 is maintained in an open position at a degree proportional to the differences between the pressures acting on the opposite faces of the diaphragm.

In the refrigeration system, the liquid refrigerant from line $P_2$ is expanded at the expansion valve 40 and supplied into the evaporator coil 50*a* through a line $P_3$ to freeze the water flowing down through a first upright ice making unit 70*a*. The evaporator coil 50*b* is supplied with the refrigerant from evaporator coil 50*a* through line $P_4$ to freeze the water flowing down through a second upright ice making unit 70*b*. The refrigerant from the outlet of evaporator coil 50*b* is circulated into the compressor 10 through the return line $P_5$. A hot gas bypass line $P_6$ is connected at its inlet to an intermediate portion of line $P_1$ between the compressor 10 and condensing coil 20 and at its outlet to line $P_3$ downstream of the expansion valve 40. A solenoid valve 60 for hot gas is disposed within the bypass line $P_6$ to supply a hot gas under high pressure outflowing from the compressor 10 directly into the evaporator coil 50*a* through the bypass line $P_6$ and line $P_3$ when it has been energized during the defrost cycle.

In the ice making machine, a motor driven pump 80 is connected at its inlet to a water tank 90 and at its outlet to an upstanding water supply pipe $P_7$ the upper end of which is connected to watering containers 100*a* and 100*b*. During the freezing cycle, the watering containers 100*a*, 100*b* are supplied with the water pumped up by operation of pump 80 from water tank 90. The water flowing down from watering containers 100*a*, 100*b* is received by the upright ice making units 70*a*, 70*b* to flow downwardly therethrough into the water tank 90. In this instance, the water flows down into the water tank 90 through a perforated water plate 110. During the defrost cycle, the upright ice making units 70*a*, 70*b* are supplied with water from an external source of water through a water valve 120 and a water supply pipe $P_8$ and permit the water to flow downwardly along the respective back surfaces of units 70*a*, 70*b* into the water tank 90. In this instance, the respective freezing cells of units 70*a*, 70*b* are warmed by thermal exchange with the hot gas flowing through the evaporator coils 50*a*, 50*b* to release frozen ice cubes therefrom. In the figure, the reference characters $S_1$ and $S_2$ indicate a water level senser provided with a float switch and a thermister located on return line $P_5$, respectively, and the reference numeral 90*a* indicates an overflow pipe in the water tank 90.

Assuming that the compressor 10 has been activated to compress the gaseous refrigerant from return line $P_5$ and deliver it through line $P_1$ to condensing coil 20, the gaseous refrigerant is cooled and liquified by the condensing coil 20 and supplied to the expansion valve 40 through the dryer 30 and line $P_2$. The expansion valve 40 acts to expand the liquified refrigerant and supply it into the evaporator coil 50*a* through line $P_3$. In this instance, the openig degree of expansion valve 40 is controlled in accordance with the pressure of refrigerant applied from the external equalizer pipe 42, the thermal expansion pressure applied from the thermostat bulb 43 and the spring pressure applied thereto. The expanded refrigerant from line $P_3$ flows, in sequence, through the evaporator coil 50*a*, line $P_4$ and evaporator coil 50*b* and is circulated to the compressor 10 through return line $P_5$. On the other hand, the watering containers 100*a*, 100*b* are supplied wi h the water from tank 90 through pipe $P_7$ under operation of the pump 80. The water flowing down from the watering containers is supplied to the upright ice making units 70*a*, 70*b* to flow downwardly therethrough to be frozen by thermal exchange with the evaporator coils 50*a*, 50*b*.

When the water flowing down from the watering containers is progressively frozen into the cubes in the freezing cells of units 70*a*, 70*b* during the freezing cycle, the water level in tank 90 will gradually fall to a minimum level. This is detected by the water level senser $S_1$, and in turn, the pump 80 is stopped in response to an electric signal from sensor $S_1$ under control of an electric control circuit (not shown). Subsequently, the solenoid valve 60 for hot gas is energized under control of the electric control circuit to supply the hot gas outflowing from compressor 10 directly into the evaporator coils 50*a*, 50*b* through lines $P_6$, $P_3$. In this instance, the water valve 120 is opened under control of the electric control circuit to supply water from the external source of water to the upright ice making units 70*a*, 70*b* through pipe $P_8$. Thus, the water from pipe $P_8$ flows down along the respective back surfaces of units 70*a*, 70*b*, while the units 70*a*, 70*b* are warmed by thermal exchange with the hot gas flowing through the evaporator coils 50*a*, 50*b* to release the frozen ice cubes therefrom. The released ice cubes are received and guided by the water plate 110 to be accumulated in an ice storage bin associated with the ice making machine.

During the defrost cycle described above, the pressure of refrigerant in line $P_4$ is increased by the hot gas applied from the solenoid valve 60 and becomes higher than that during the freezing cycle. As a result, the pressure in external equalizer pipe 42 becomes higher than that during the freezing cycle, and the thermal expansion pressure of sealed inert gas from the thermostat bulb 43 causes the internal pressure of expansion valve body 41 to exceed the predetermined maximum working pressure. This is effective to rapidly close the expansion valve 40 thereby to supply only the hot gas from compressor 10 to the evaporator coils 50*a*, 50*b* during the defrost cycle.

While there have been described what are at present considered to be preferred embodiments of the invention, it will be understood that various other modifications may be made therein, and it is intended that the appended claims cover all such modifications as fall within the true spirit and scope of the invention.

What is claimed is:

1. A refrigeration system in an ice making machine comprising:

a refrigerant compressor;

a condensing coil;

an evaporator coil connected at an inlet side thereof to an outlet of said refrigerant compressor through said condensing coil and connected at an outlet side thereof to an inlet of said refrigerant compressor;

an externally equalized type of expansion valve interposed between said condensing coil and said evaporator coil to expand a liquified refrigerant applied thereto from said condensing coil and supply expanded liquified refrigerant into said evaporator coil;

a hot gas bypass line connected in parallel with said condensing coil and said expansion valve;

a normally closed type solenoid valve disposed within said hot gas bypass line to permit a flow of hot gas supplied therethrough from said refrigerant compressor into said evaporator coil when said solenoid valve has been energized;

an external equalizer pipe having an extremity connected to an intermediate portion of said evaporator coil between the inlet and outlet sides thereof and having another end connected to said expansion valve;

a return line between the outlet side of said evaporator coil and said refrigerant compressor; and a thermostat bulb, located on said return line, filled with thermally expandable fluid an amount of which is determined to cause a maximum working pressure acting on said expansion valve higher than a pressure of refrigerant at the intermediate portion of said evaporator coil during a freezing cycle of the refrigeration system and lower than a pressure of hot gas at the intermediate portion of said evaporator coil during a defrost cycle of the refrigeration system.

2. A refrigeration system as claimed in claim 1, wherein a first evaporator coil is connected at an inlet side thereof to said condensing coil through said expansion valve and a second evaporator coil is connected at an inlet side thereof of an outlet side of said first evaporator coil, and wherein the extremity of said external equalizer pipe is connected to an intermediate line between said first and second evaporator coils.

* * * * *